US008346143B2

(12) United States Patent
Okamoto et al.

(10) Patent No.: US 8,346,143 B2
(45) Date of Patent: Jan. 1, 2013

(54) FIXING DEVICE AND IMAGE FORMING APPARATUS CAPABLE OF EFFECTIVELY CIRCULATING AND APPLYING OIL FOR FIXING

(75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Yoshihiro Sonohara, Hitachi (JP); Syoichi Kaneko, Ishioka (JP); Keisuke Kubota, Hitachinaka (JP); Takashi Kagami, Mito (JP); Hiroyuki Shimada, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 12/453,193

(22) Filed: May 1, 2009

(65) Prior Publication Data

US 2009/0274497 A1 Nov. 5, 2009

(30) Foreign Application Priority Data

May 1, 2008 (JP) ..... 2008-119690

(51) Int. Cl.
*G03G 15/20* (2006.01)

(52) U.S. Cl. ..... 399/325

(58) Field of Classification Search ..... 399/325, 399/328

See application file for complete search history.

(56) References Cited

U.S. PATENT DOCUMENTS 3,999,510 A * 12/1976 Thettu ..... 399/327
4,182,263 A * 1/1980 Naeser et al. ..... 118/60
4,231,653 A 11/1980 Nagahara et al.
4,287,280 A * 9/1981 Swift ..... 430/124.37
4,770,116 A * 9/1988 Moser ..... 118/60
5,300,996 A 4/1994 Yokoyama et al.
5,543,904 A * 8/1996 Kato et al. ..... 399/335
5,678,149 A 10/1997 Takekoshi et al.
5,678,153 A 10/1997 Okamoto et al.
5,679,462 A 10/1997 Soga et al.
5,768,655 A * 6/1998 Yoshino et al. ..... 399/69
6,360,072 B1 * 3/2002 Costrop et al. ..... 399/325
6,647,221 B1 11/2003 Furuyama
6,980,762 B2 12/2005 Bogoshian
7,164,878 B2 1/2007 Yamanaka (Continued)

FOREIGN PATENT DOCUMENTS

JP 04257885 A * 9/1992

(Continued)

OTHER PUBLICATIONS

Abstract of JP 2003-302857 published on Oct. 24, 2003.

(Continued)

*Primary Examiner* — Quana M Grainger
(74) *Attorney, Agent, or Firm* — Harness, Dickey & Pierce, P.L.C.

(57) ABSTRACT

A fixing device includes a rotatable first nip formation member, a rotatable second nip formation member, and an oil applier. The second nip formation member is provided under the first nip formation member to contact the first nip formation member. The oil applier includes an oil pan, an oil receiver, and an oil filter. The oil pan is provided under the second nip formation member to contain oil in which the second nip formation member is dipped. The oil receiver holds the oil pan. The oil filter is provided between the oil pan and the oil receiver to filter oil overflowing the oil pan.

17 Claims, 8 Drawing Sheets

U.S. PATENT DOCUMENTS

| | | | | |
|---|---|---|---|---|
| 7,509,085 | B2 | 3/2009 | Yoshinaga et al. | |
| 2001/0022908 | A1 * | 9/2001 | Mikita | 399/324 |
| 2002/0044805 | A1 | 4/2002 | Hasegawa | |
| 2003/0095806 | A1 | 5/2003 | Wu et al. | |
| 2006/0165443 | A1 | 7/2006 | Yoshinaga et al. | |
| 2006/0177232 | A1 | 8/2006 | Ehara et al. | |
| 2006/0198646 | A1 | 9/2006 | Funabiki et al. | |
| 2007/0237554 | A1 | 10/2007 | Mitsuya et al. | |
| 2008/0013995 | A1 | 1/2008 | Kubota et al. | |
| 2008/0035002 | A1 * | 2/2008 | Kuo | 101/480 |
| 2008/0170896 | A1 | 7/2008 | Kubota et al. | |
| 2009/0274498 | A1 * | 11/2009 | Okamoto et al. | 399/327 |

FOREIGN PATENT DOCUMENTS

| | | | |
|---|---|---|---|
| JP | 5-027648 | | 2/1993 |
| JP | 07160141 | A * | 6/1995 |
| JP | 9-319243 | | 12/1997 |
| JP | 2000241117 | A * | 9/2000 |
| JP | 2005055810 | A * | 3/2005 |
| JP | 2008-046663 | | 2/2008 |
| JP | 2008-065349 | | 3/2008 |

OTHER PUBLICATIONS

Office Action dated Jan. 10, 2011 for corresponding U.S. Appl. No. 12/434,195.
Office Action dated Jan. 4, 2011 for corresponding U.S. Appl. No. 12/434,213.
Office Action dated May 17, 2011 for corresponding U.S. Appl. No. 12/434,288.
Office Action dated Dec. 21, 2010 for corresponding U.S. Appl. No. 12/434,288.
Office Action dated Aug. 17, 2011 for corresponding U.S. Appl. No. 12/434,223.
Notice of Allowance dated Jun. 3, 2011 for corresponding U.S. Appl. No. 12/434,213.
Notice of Allowance dated Jun. 2, 2011 for corresponding U.S. Appl. No. 12/434,195.

* cited by examiner

FIXING DEVICE AND IMAGE FORMING APPARATUS CAPABLE OF EFFECTIVELY CIRCULATING AND APPLYING OIL FOR FIXING

PRIORITY STATEMENT

The present patent application claims priority from Japanese Patent Application No. 2008-119690, filed on May 1, 2008, in the Japan Patent Office, the entire contents of which are hereby incorporated herein by reference.

BACKGROUND OF THE INVENTION

1. Field of the Invention

Example embodiments generally relate to a fixing device and an image forming apparatus, and more particularly, to a fixing device and an image forming apparatus including the fixing device for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In such image forming apparatuses, oil is applied to a fixing member of the fixing device, which contacts the toner image on the sheet, to separate toner particles forming the toner image from the fixing member and to maintain fixing property, or the ability of the fixing member to fix the toner image on the sheet. Understanding the way in which the oil is applied requires a detailed discussion of the structure of a typical conventional fixing device.

In order to shorten a warm-up time period of the fixing device, an endless fixing belt is often used as the fixing member. FIG. 1 is a sectional view of a fixing device 100RA including just such an endless fixing belt.

As can be seen in FIG. 1, the fixing device 100RA loops an endless fixing belt 92 around a fixing roller 84 and a heating roller 83 in such a manner that the fixing roller 84 and the heating roller 83 apply a reference tension to the fixing belt 92. A pressing roller 85 rotates and presses against the fixing belt 92 and the fixing roller 84 to form a fixing nip portion AR between the fixing belt 92 and the pressing roller 85. A heater 86 is disposed inside the heating roller 83, and heats the fixing belt 92 via the heating roller 83. Similarly, a second, separate heater 87 is disposed inside the pressing roller 85, and heats the pressing roller 85. The fixing belt 92 and the pressing roller 85 apply heat and pressure to a sheet bearing a toner image at the fixing nip portion AR to fix the toner image on the sheet.

An oil application roller R1 serves as an oil applier for applying oil to the fixing belt 92. For example, the rotating oil application roller R1 applies oil supplied from an oil supplier to the fixing belt 92 at a contact point 95 at which the oil application roller R1 contacts the fixing belt 92. The rotating fixing belt 92 moves an oiled portion of the fixing belt 92 to which oil is applied to the fixing nip portion AR to separate the sheet bearing the toner image from the fixing belt 92. At the fixing nip portion AR, a part of the oil on the fixing belt 92 moves from the fixing belt 92 onto a surface of the pressing roller 85 to separate the sheet bearing the toner image from the pressing roller 85. Surplus oil carried on the pressing roller 85 then flows into an oil pan 96 provided under the pressing roller 85, and is collected by the oil pan 96.

The oil collected by the oil pan 96 is pumped to the oil application roller R1 for reuse. However, after repeated circulation and reuse there may not be enough oil left to pump.

On the other hand, when a plurality of sheets continuously passes through the fixing nip portion AR, oil can only move from the fixing belt 92 onto the pressing roller 85 during an interval between successive sheets, resulting in a shortage of oil.

Further, simple gravity can easily cause a sheet passing through the fixing nip portion AR to adhere to or wrap around the pressing roller 85 at an exit side of the fixing nip portion AR.

To address these problems, another related-art fixing device 100RB includes an oil applier R3 for applying oil to the pressing roller 85 by directly contacting the pressing roller 85, as illustrated in FIG. 2. However, when coated paper is used as a sheet P, the oil applier R3 may not apply enough oil to separate the coated paper, which absorbs oil easily, from the pressing roller 85. Moreover, it is difficult to locate an oil applier capable of applying a substantial amount of oil to the pressing roller 85 at a position above the pressing roller 85 due to limited space.

SUMMARY

At least one embodiment may provide a fixing device that includes a rotatable first nip formation member, a rotatable second nip formation member, and an oil applier. The second nip formation member is provided under the first nip formation member to contact the first nip formation member. The oil applier includes an oil pan, an oil receiver, and an oil filter. The oil pan is provided under the second nip formation member to contain oil in which the second nip formation member is dipped. The oil receiver holds the oil pan. The oil filter is provided between the oil pan and the oil receiver to filter oil overflowing the oil pan.

At least one embodiment may provide an image forming apparatus that includes an oil circulation system for circulating oil and a fixing device for receiving oil sent from the oil circulation system. The fixing device includes a rotatable first nip formation member, a rotatable second nip formation member, and an oil applier. The rotatable second nip formation member is provided under the first nip formation member to contact the first nip formation member. The oil applier includes an oil pan, an oil receiver, and an oil filter. The oil pan is provided under the second nip formation member to contain oil in which the second nip formation member is dipped. The oil receiver holds the oil pan. The oil filter is provided between the oil pan and the oil receiver to filter oil overflowing the oil pan. The oil circulation system receives oil filtered by the oil filter and resupplies the filtered oil to the oil applier of the fixing device.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
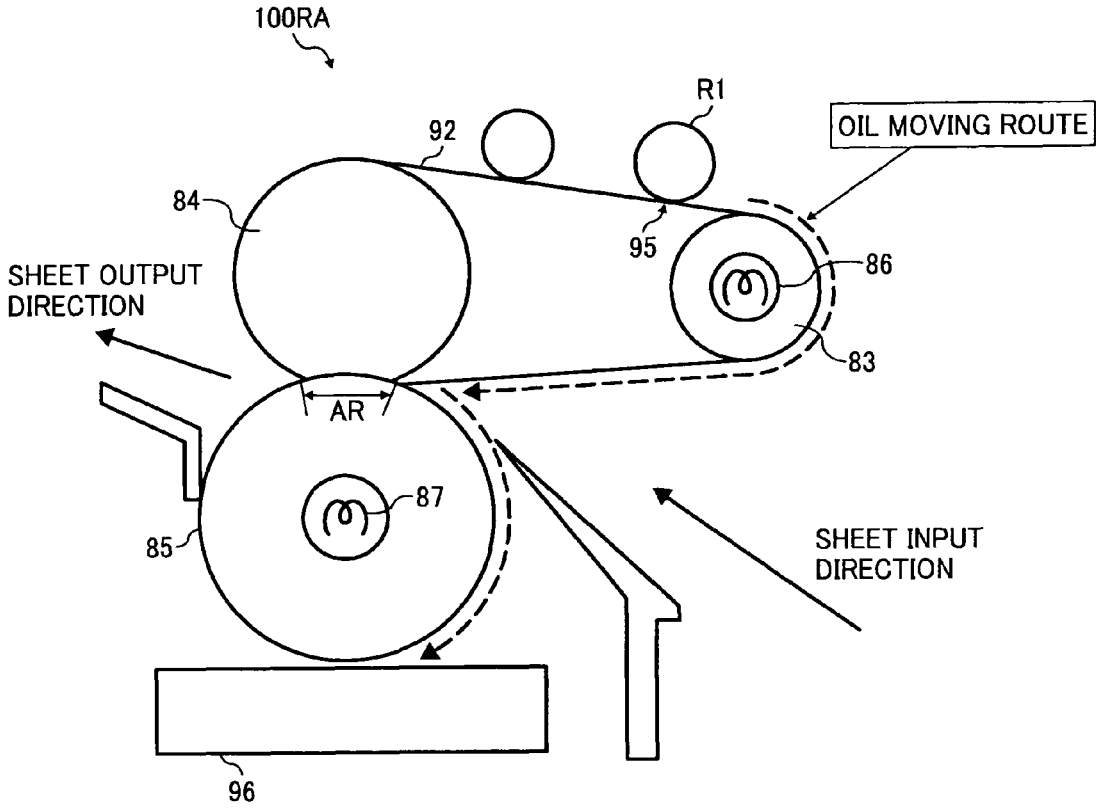
FIG. 1 RELATED ART
FIG. 1 is a sectional view of a related-art fixing device.
Figure 2:
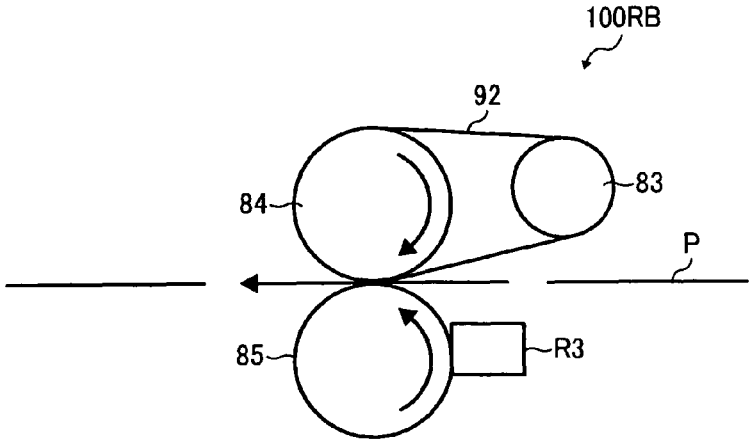
FIG. 2 RELATED ART
FIG. 2 is a sectional view of another related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms a "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
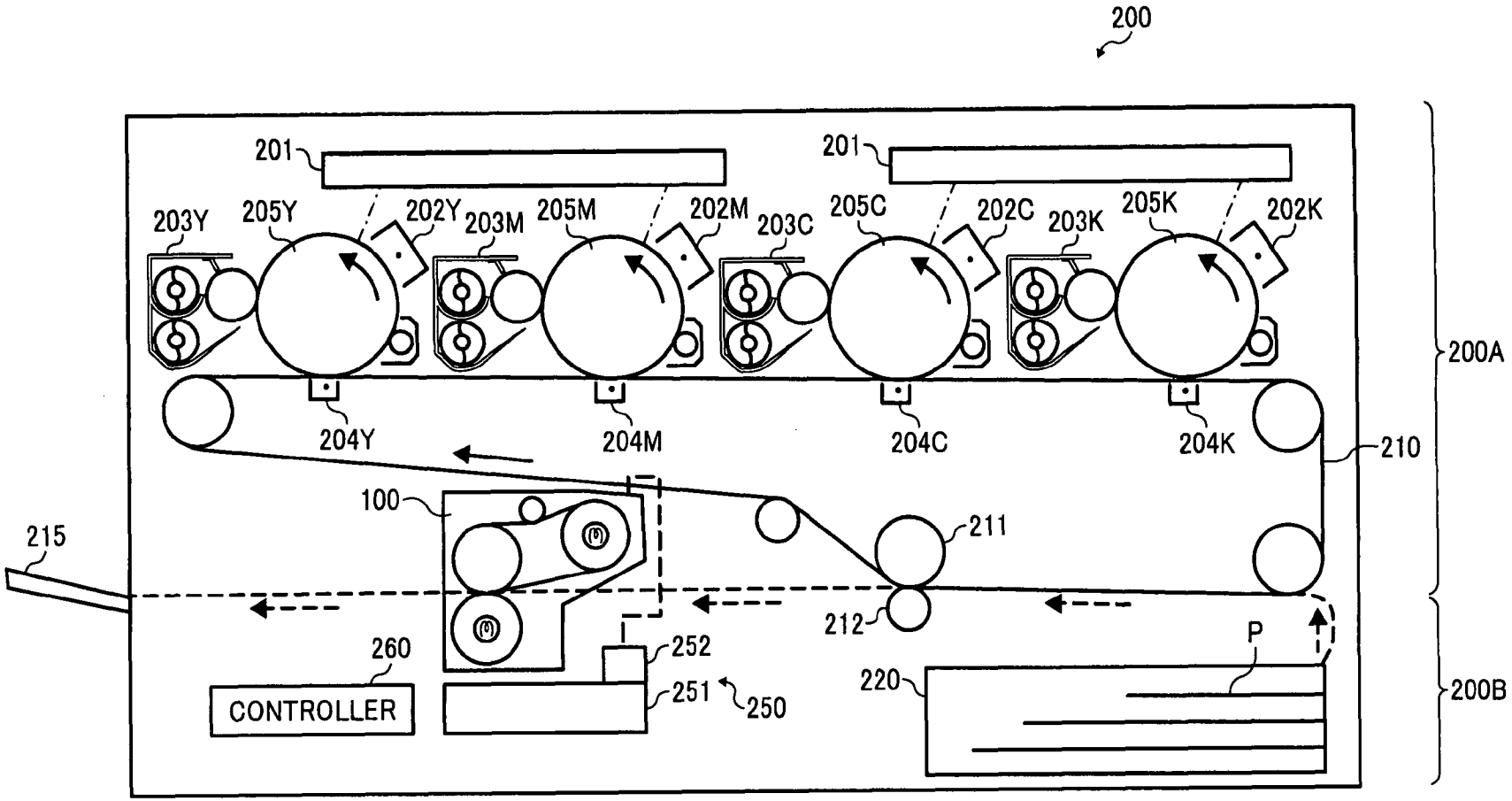
FIG. 3 is a sectional view of an image forming apparatus according to an example embodiment.

Referring now to the drawings, wherein like reference numerals designate identical or corresponding parts throughout the several views, particularly to FIG. 3, an image forming apparatus 200 according to an example embodiment is explained.

As illustrated in FIG. 3, the image forming apparatus 200 includes an image forming device 200A, a sheet supplier 200B, a stacker 215, and/or a controller 260.

The image forming device 200A includes optical writers 201, chargers 202Y, 202M, 202C, and 202K, development devices 203Y, 203M, 203C, and 203K, first transfer devices 204Y, 204M, 204C, and 204K, photoconductors 205Y, 205M, 205C, and 205K, a transfer belt 210, a roller 211, a transfer roller 212, a fixing device 100, and/or an oil circulation mechanism 250. The sheet supplier 200B includes a paper tray 220. The oil circulation mechanism 250 includes an oil tank 251 and/or an oil pump 252.

The image forming apparatus 200 can be a copier, a facsimile machine, a printer, a plotter, a multifunction printer having at least one of copying, printing, scanning, plotter, and facsimile functions, or the like. According to this example embodiment of the present invention, the image forming apparatus 200 functions as a tandem type color copier for forming a color image on a recording medium at high speed by electrophotography.

The image forming device 200A is provided at a center portion of the image forming apparatus 200. The sheet supplier 200B is provided under the image forming device 200A. An image reader is provided above the image forming device 200A.

In the image forming device 200A, the transfer belt 210 includes a transfer surface extending in a horizontal direction. A mechanism for forming an image in a complementary color being complementary to a separation color is provided above the transfer belt 210. For example, the photoconductors 205Y, 205M, 205C, and 205K, serving as image carriers for carrying toner images in complementary colors (e.g., yellow, magenta, cyan, and black), are arranged along the transfer surface of the transfer belt 210.

The photoconductors 205Y, 205M, 205C, and 205K are formed of drums which rotate in an identical direction (e.g., counterclockwise in FIG. 3), respectively. The optical writers 201, the chargers 202Y, 202M, 202C, and 202K, the development devices 203Y, 203M, 203C, and 203K, the first transfer devices 204Y, 204M, 204C, and 204K, and cleaners surround the photoconductors 205Y, 205M, 205C, and 205K, respectively, to perform image forming processes while the photoconductors 205Y, 205M, 205C, and 205K rotate. The development devices 203Y, 203M, 203C, and 203K contain yellow, magenta, cyan, and black toners, respectively.

The transfer belt 210 is looped over a driving roller and a driven roller, and opposes the photoconductors 205Y, 205M, 205C, and 205K to move in a direction corresponding to the direction of rotation of the photoconductors 205Y, 205M, 205C, and 205K. The transfer roller 212 opposes the roller 211 serving as a driven roller.

In the sheet supplier 200B, the paper tray 220 loads sheets P serving as a recording medium. A conveyance mechanism feeds the sheets P loaded on the paper tray 220 one by one toward the transfer roller 212. For example, the conveyance mechanism separates an uppermost sheet P from other sheets P loaded on the paper tray 220, and conveys the sheet P toward the transfer roller 212. A conveyance path provided between the transfer roller 212 and the fixing device 100 conveys the sheet P in a horizontal direction. The controller 260 controls operations of the image forming apparatus 200.

The following describes image forming operations performed by the image forming apparatus 200. The charger 202Y uniformly charges a surface of the photoconductor 205Y. The optical writer 201 forms an electrostatic latent image on the charged surface of the photoconductor 205Y according to image data sent by the image reader. The development device 203Y for containing the yellow toner makes the electrostatic latent image formed on the photoconductor 205Y visible as a yellow toner image. The first transfer device 204Y applies a reference bias to the yellow toner image formed on the photoconductor 205Y to transfer the yellow toner image onto the transfer belt 210. Similarly, magenta, cyan, and black toner images are formed on the photoconductors 205M, 205C, and 205K, respectively, and sequentially transferred onto the transfer belt 210 by an electrostatic force so that the yellow, magenta, cyan, and black toner images are superimposed on the transfer belt 210 to form a color toner image on the transfer belt 210.

The transfer roller 212 transfers the color toner image from the transfer belt 210 onto the sheet P conveyed by the roller 211 and the transfer roller 212. The sheet P bearing the color toner image is further conveyed to the fixing device 100. The fixing device 100 fixes the color toner image on the sheet P. The sheet P bearing the fixed color toner image is sent to the stacker 215 via an output path.

The oil tank 251 collects oil used in the fixing device 100 to improve property for separating the sheet P from the fixing device 100. The oil pump 252 resupplies oil contained in the oil tank 251 to the fixing device 100. The oil tank 251 and the oil pump 252 serve as the oil circulation mechanism 250 provided for the fixing device 100.

Figure 4:
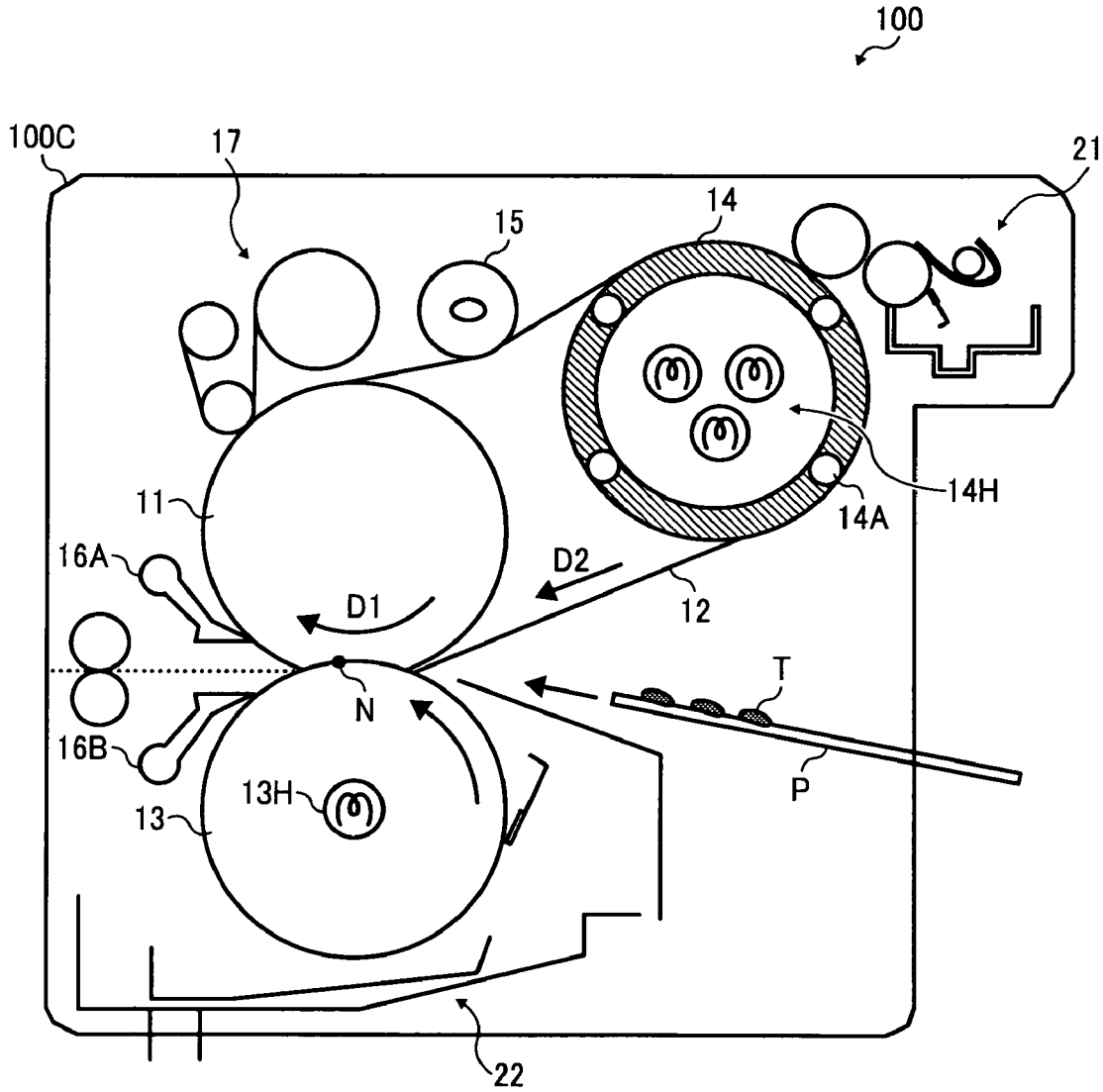
FIG. 4 is a sectional view (according to an example embodiment) of a fixing device included in the image forming apparatus shown in FIG. 3.

FIG. 4 is a sectional view of the fixing device 100. The fixing device 100 includes a fixing cover 100C, a fixing roller 11, a fixing belt 12, a pressing roller 13, a heater 13H, a heating roller 14, a heat pipe 14A, a heater 14H, a tension roller 15, separation nails 16A and 16B, a cleaning mechanism 17, and/or oil appliers 21 and 22.

The fixing roller 11, the fixing belt 12, the pressing roller 13, the heating roller 14, the separation nails 16A and 16B, and the cleaning mechanism 17 are provided inside the fixing cover 100C. The fixing belt 12, serving as a first nip formation member and a fixing member, is looped or stretched over the fixing roller 11 and the heating roller 14 with a reference tension. The pressing roller 13, serving as a second nip formation member and a pressing member, is provided under the fixing belt 12 and rotatably presses against the fixing belt 12 to form a fixing nip portion N between the fixing belt 12 and the pressing roller 13. The fixing belt 12 and the pressing roller 13 apply heat and pressure to a sheet P bearing a toner image T at the fixing nip portion N to fix the toner image T on the sheet P. The separation nail 16A is provided at an exit side of the fixing nip portion N in such a manner that a head of the separation nail 16A contacts or is disposed close to the fixing belt 12, so as to prevent a sheet P from wrapping around the fixing belt 12. The separation nail 16B is provided at the exit side of the fixing nip portion N in such a manner that a head of the separation nail 16B contacts the pressing roller 13, so as to prevent a sheet P from wrapping around the pressing roller 13. The cleaning mechanism 17 cleans the fixing belt 12 by pressing a cleaning web against the fixing belt 12.

The fixing belt 12 has an endless belt shape and has a double-layer structure in which an elastic layer, such as a silicon rubber layer, is formed on a base including nickel, stainless steel, and/or polyimide. The fixing roller 11 includes metal serving as a core metal and silicon rubber. In order to shorten a warm-up time period of the fixing device 100, the fixing roller 11 may include foamed silicon rubber so that the fixing roller 11 does not absorb heat from the fixing belt 12 easily. The heating roller 14 is formed of a hollow roller including aluminum or iron. The heater 14H, such as a halogen heater, serves as a heat source and is provided inside the heating roller 14. Alternatively, an induction heating (IH) mechanism may serve as the heat source. A plurality of heat pipes 14A, which is formed of hollow pipes, is provided in a thick wall of the heating roller 14. For example, the heat pipes 14A are embedded in the thick wall of the heating roller 14 in such a manner that the heat pipes 14A are evenly spaced in a circumferential direction of the heating roller 14 and that a longitudinal direction of the heat pipes 14A corresponds to a longitudinal direction (e.g., a width direction or an axial direction) of the heating roller 14. The heat pipes 14A improve heat transmission from the heater 14H to a surface of the heating roller 14, and thereby the heating roller 14 uniformly heats the fixing belt 12 quickly.

When the fixing device 100 is driven, in a state in which the tension roller 15 presses against the fixing belt 12 to apply proper tension to the fixing belt 12, the fixing roller 11 rotates clockwise in FIG. 4 in a direction of rotation D1 to rotate the fixing belt 12 clockwise in FIG. 4 in a direction of rotation D2 in which the fixing belt 12 feeds a sheet P out of the fixing nip portion N. Thus, the rotating fixing belt 12 rotates the pressing roller 13. Alternatively, instead of the fixing roller 11, the pressing roller 13 or the heating roller 14 may drive and rotate the fixing belt 12. In order to fix a toner image T on a sheet P, the heater 14H provided inside the heating roller 14 generates heat to heat the fixing belt 12 until a thermistor detects that the fixing belt 12 is heated up to a reference temperature (e.g., a proper fixing temperature). According to this example embodiment, the fixing belt 12, that is, an endless belt, serves as a fixing member. Alternatively, a fixing roller, for example, a hollow cylindrical roller may serve as a fixing member.

The pressing roller 13 is formed of a cylindrical roller in which an elastic layer including silicon rubber is provided on a core metal including aluminum or iron. A pressure application-release member moves the pressing roller 13 toward the fixing belt 12 to cause the pressing roller 13 to apply pressure to the fixing belt 12, and separates the pressing roller 13 from the fixing belt 12 to release pressure applied by the pressing roller 13 to the fixing belt 12. When the fixing device 100 is driven, the pressure application-release member applies constant pressure to the pressing roller 13 to press the pressing roller 13 against the fixing belt 12. The heater 13H is provided inside the pressing roller 13, and generates heat to heat the pressing roller 13 up to a reference temperature as needed, for example, to fix a toner image T on a sheet P.

According to this example embodiment, the pressing roller 13 having a roller shape serves as a pressing member. Alternatively, an endless belt looped over at least two rollers may serve as a pressing member.

In the fixing device 100, a surface of the fixing belt 12 is heated up to a reference temperature in a state in which the fixing belt 12 and the pressing roller 13 are driven and rotated. When a sheet P bearing an unfixed toner image T passes through the fixing nip portion N, that is, when the sheet P moves leftward in FIG. 4, the fixing belt 12 and the pressing roller 13 apply heat and pressure to the sheet P at the fixing nip portion N to melt and fix the unfixed toner image T on the sheet P.

When the sheet P bearing the fixed toner image T is discharged from the fixing nip portion N, the sheet P may adhere to or wrap around the fixing belt 12 or the pressing roller 13. To address this, the oil appliers 21 and 22 apply oil to the fixing belt 12 and the pressing roller 13 to improve property for separating the sheet P from the fixing belt 12 and the pressing roller 13, respectively. The applied oil may be heat-resistant fixed oil, such as silicon oil. When the head of the separation nail 16A or 16B contacts a leading edge of the sheet P, the separation nail 16A or 16B separates the sheet P from the fixing belt 12 or the pressing roller 13, respectively. The sheet P discharged from the fixing nip portion N passes through a discharge path and is sent out of the fixing device 100.

The oil appliers 21 and 22 apply a proper amount of oil to the fixing belt 12 and the pressing roller 13, respectively. The separation nails 16A and 16B provided at the exit side of the fixing nip portion N operate as needed. Accordingly, the sheet P is discharged out of the fixing nip portion N to the exit side of the fixing nip portion N without adhering to or wrapping around the fixing belt 12 or the pressing roller 13.

Figure 5:
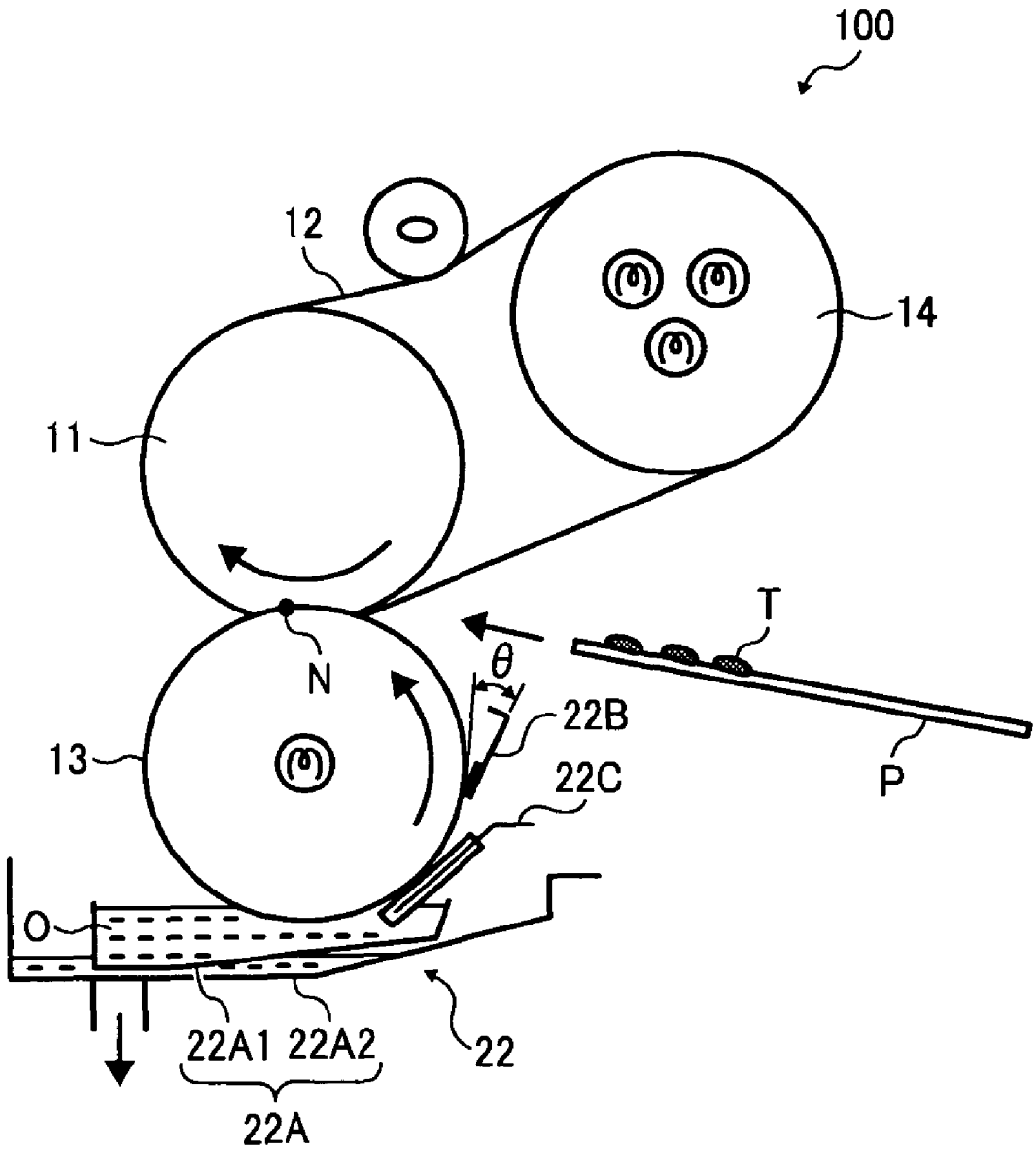
FIG. 5 is a partially sectional view (according to an example embodiment) of the fixing device shown in FIG. 4.

FIG. 5 is a partially sectional view of the fixing device 100. The oil applier 22 includes an oil pan 22A, a blade 22B, and/or a cleaning felt 22C. The oil pan 22A includes a sub oil pan 22A1 and/or a main oil pan 22A2.

In the fixing device 100, the rotatable fixing belt 12, serving as a first nip formation member and a fixing member, contacts the rotatable pressing roller 13, serving as a second nip formation member and a pressing member, provided under the fixing belt 12 to form the fixing nip portion N between the fixing belt 12 and the pressing roller 13. The sub oil pan 22A1 is provided under the pressing roller 13 and contains oil O in which a part of the pressing roller 13 is dipped. The blade 22B is provided downstream from the sub oil pan 22A1 and upstream from the fixing nip portion N in a direction of rotation of the pressing roller 13, and serves as an oil regulating member for regulating an amount of oil O adhering to the pressing roller 13.

The oil pan 22A is fixed inside the fixing cover 100C (depicted in FIG. 4) of the fixing device 100, and includes two pans, which are the sub oil pan 22A1 serving as an oil pan for containing oil O in which a part of the pressing roller 13 is dipped and the main oil pan 22A2 serving as an oil receiver for holding the whole sub oil pan 22A1. Oil O to be applied to the pressing roller 13 is supplied from an outside of the oil applier 22 into the sub oil pan 22A1 and stored in the sub oil pan 22A1. The sub oil pan 22A1 has a rectangular shape. A long length of the sub oil pan 22A1 is equal to or longer than at least a long length (e.g., a width) of the pressing roller 13, that is, a length in a longitudinal direction (e.g., a width direction or an axial direction) of the pressing roller 13.

The pressing roller 13 is constantly dipped in oil O in the sub oil pan 22A1 wholly in the width direction (e.g., the axial direction) and partially in a diametrical direction (e.g., a direction perpendicular to the width direction) of the pressing roller 13. For example, an oil level of the sub oil pan 22A1 is higher than a lower end of the pressing roller 13 even when the pressure application-release member presses the pressing roller 13 against the fixing belt 12. The lower end of the pressing roller 13 does not touch an inner bottom of the sub oil pan 22A1 even when pressure applied by the pressure application-release member to the pressing roller 13 is released. Oil O may be applied to the pressing roller 13 before a sheet P passes through the fixing nip portion N. Therefore, the pressing roller 13 needs not be dipped in oil O in the sub oil pan 22A1 constantly. For example, the pressing roller 13 may be dipped in oil O in the sub oil pan 22A1 when the pressing roller 13 starts rotating.

The main oil pan 22A2 serves as an oil receiver for receiving oil O overflowing the sub oil pan 22A1. An outlet through which oil O is collected into the oil tank 251 depicted in FIG. 3 is provided under the main oil pan 22A2.

The sub oil pan 22A1 and the main oil pan 22A2 may include heat-resistant metal or plastic not reacting to oil O.

The blade 22B includes an elastic member having a paddle-like shape and has a width equal to or longer than at least the width of the pressing roller 13. A long edge of the blade 22B constantly contacts a surface of the pressing roller 13. In other words, a longitudinal direction of the blade 22B corresponds to the longitudinal direction (e.g., the width direction or the axial direction) of the pressing roller 13. Thus, the blade 22B regulates an amount of oil O adhering to the pressing roller 13 so that a reference amount of oil O is adhered to the pressing roller 13 uniformly in the width direction of the pressing roller 13. The blade 22B includes a material not damaging the surface of the pressing roller 13, such as fluorocarbon rubber.

The surface of the pressing roller 13 includes a material corresponding to oil O. For example, when silicon oil is used as oil O, the surface of the pressing roller 13 includes silicon rubber. Therefore, when the pressing roller 13 is dipped in oil O in the sub oil pan 22A1, the silicon rubber of the pressing roller 13 swells and holds oil O. The blade 22B contacts a lower surface of the pressing roller 13 to scrape oil O off the surface of the pressing roller 13. For example, an angle θ formed by a head of the blade 22B and a tangent line of the head of the blade 22B tangent to a curve of the pressing roller 13 is an acute angle smaller than about 90 degrees. The head of the blade 22B opposes the direction of rotation of the pressing roller 13 to scrape surplus oil O off the surface of the pressing roller 13 into the oil pan 22A. Accordingly, the surface of the pressing roller 13 carries a sufficient amount of oil O uniformly applied on the surface of the pressing roller 13 in the width direction of the pressing roller 13, which can provide proper property for separating a sheet P bearing a fixed toner image T from the pressing roller 13. Surplus oil O on the pressing roller 13 is collected into the oil pan 22A and reused. Namely, surplus oil O is circulated and applied to the pressing roller 13 again.

The cleaning felt 22C may be provided between the oil pan 22A, and the blade 22B. The cleaning felt 22C serves as a cleaner for cleaning the surface of the pressing roller 13 by contacting the pressing roller 13. The cleaning felt 22C may be a compressed sheet including heat-resistant fiber not reacting to oil O, such as meta-aramid fiber. While oil O permeates the fiber of the cleaning felt 22C, the cleaning felt 22C captures fine solid impurities inside. Thus, fine solid impurities (e.g., dust and calcium carbonate originating from a sheet P) contained in oil O can be removed from the surface of the pressing roller 13, while the oil O remains on the surface of the pressing roller 13.

A support supports the cleaning felt 22C in such a manner that the cleaning felt 22C contacts the pressing roller 13. When the support is formed of a metal material by sheet metal processing to have proper spring property, the support causes the cleaning felt 22C to contact the pressing roller 13 while applying constant pressure to the pressing roller 13, so as to adjust an amount of oil O adhering to the pressing roller 13.

Figure 6:
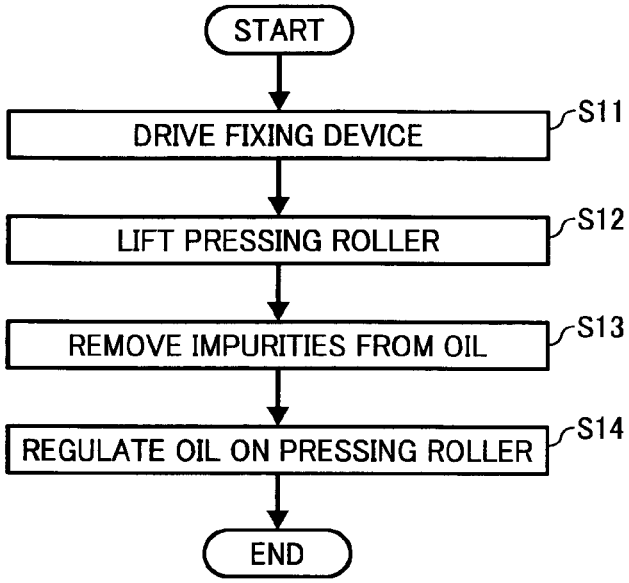
FIG. 6 is a flowchart (according to an example embodiment) illustrating a procedure for applying oil from an oil applier to a pressing roller included in the fixing device shown in FIG. 5.

Referring to FIGS. 5 and 6, the following describes a procedure for applying oil O from the oil applier 22 to the pressing roller 13 with the above-described structure. FIG. 6 is a flowchart illustrating the procedure for applying oil O from the oil applier 22 to the pressing roller 13.

In step S11, the controller 260 depicted in FIG. 3 starts driving the fixing device 100. Accordingly, the fixing belt 12 starts rotating, and the pressure application-release member causes the pressing roller 13 to contact the fixing belt 12 by applying constant pressure to the fixing belt 12 to form the fixing nip portion N between the fixing belt 12 and the pressing roller 13. Simultaneously, the rotating fixing belt 12 rotates the pressing roller 13. Alternatively, the rotating pressing roller 13 may drive and rotate the fixing belt 12.

In step S12, when the pressing roller 13 starts rotating, the surface of the pressing roller 13 dipped in oil O in the sub oil pan 22A1 is lifted toward the fixing nip portion N in a state in which the oil O is adhered to the surface of the pressing roller 13.

In step S13, the oil O adhered to the surface of the pressing roller 13 permeates the cleaning felt 22C, and the cleaning felt 22C removes solid impurities from the oil O.

In step S14, the blade 22B regulates the oil O adhered to the surface of the pressing roller 13 uniformly in the width direction of the pressing roller 13. Thereafter, the regulated oil O on the surface of the pressing roller 13 moves to the fixing nip portion N.

As described above, according to this example embodiment, the oil applier 22 applies oil O to the pressing roller 13 provided under the fixing nip portion N in a dip method by utilizing a space under the pressing roller 13. Thus, the oil applier 22 can supply a sufficient amount of oil O to the pressing roller 13 stably.

Figure 7:
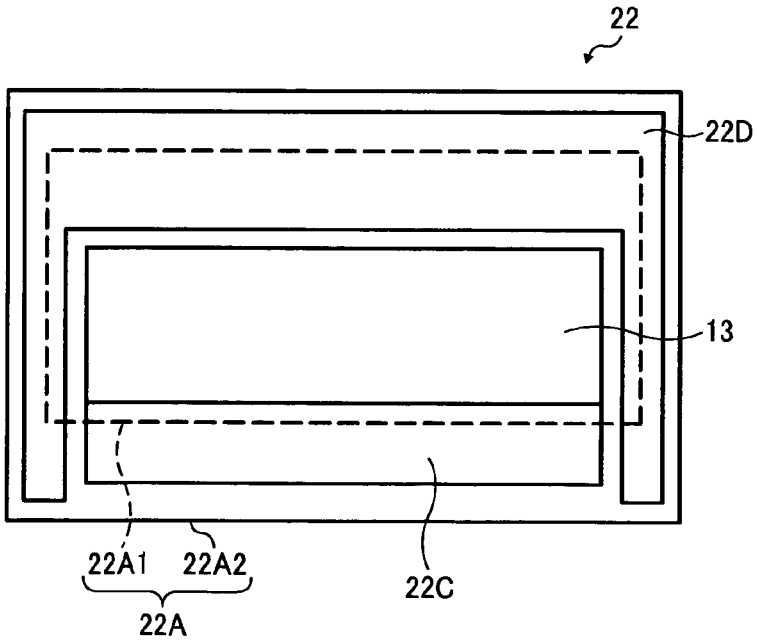
FIG. 7 is a top view (according to an example embodiment) of an oil applier included in the fixing device shown in FIG. 5.

FIG. 7 is a top view of the oil applier 22. FIG. 7 does not illustrate the blade 22B. The oil applier 22 further includes an oil spatter prevention member 22D.

In FIG. 7, the oil spatter prevention member 22D covers an oil surface of oil O contained in the oil pan 22A. For example, the oil spatter prevention member 22D covers a region of the oil surface of oil O contained in the sub oil pan 22A1 and the main oil pan 22A2 of the oil pan 22A other than a region of the oil surface of oil O in which the pressing roller 13 is dipped. The oil spatter prevention member 22D may not cover a region of the oil surface of oil O provided under the cleaning felt 22C. Thus, the oil spatter prevention member 22D can reduce or prevent oil O spattering from the oil surface of oil O contained in the oil pan 22A due to rotation of the pressing roller 13 or other vibration and thereby adhering to and staining a sheet P or a peripheral device.

The oil spatter prevention member 22D may be a compressed sheet (e.g., a felt sheet) including heat-resistant fiber not reacting to oil, such as meta-aramid fiber. The oil spatter prevention member 22D may float on the oil surface of oil O or may separate from the oil surface of oil O. Alternatively, the oil spatter prevention member 22D may include a plurality of spherical members floating on the oil surface of oil O to cover the oil surface of oil O.

In the fixing device 100 depicted in FIG. 5, the fixing belt 12, serving as a first nip formation member and a fixing member, is disposed above the pressing roller 13 serving as a second nip formation member and a pressing member. Alternatively, a fixing member serving as a first nip formation member having a roller shape may be provided above a pressing member serving as a second nip formation member having a belt shape, as illustrated in FIG. 8.

Figure 8:
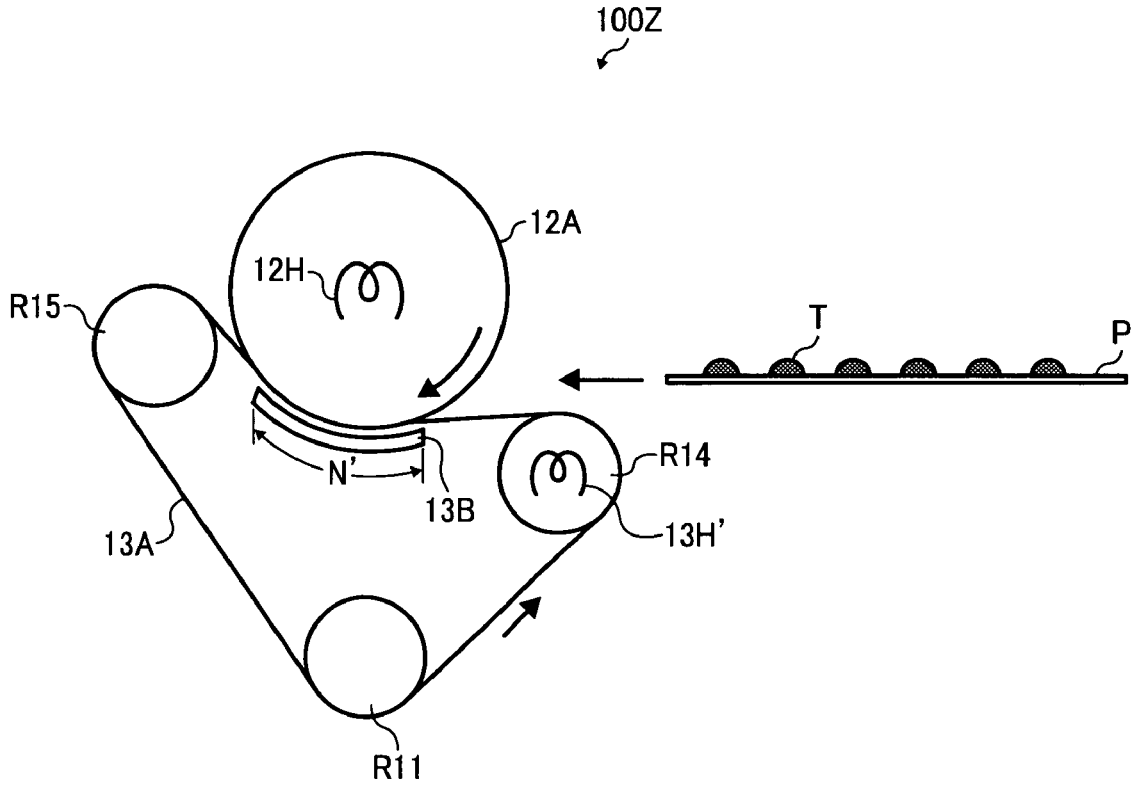
FIG. 8 is a sectional view of a fixing device according to another example embodiment.

Referring to FIG. 8, the following describes a fixing device 100Z according to another example embodiment. FIG. 8 is a sectional view of the fixing device 100Z. The fixing device 100Z includes a fixing roller 12A, a heater 12H, rollers R11, R14, and R15, a pressing belt 13A, a backup member 13B, and/or a heater 13H'.

The fixing roller 12A, serving as a first nip formation member, is provided above the pressing belt 13A serving as a second nip formation member, and rotates clockwise in FIG. 8. The pressing belt 13A provided under the fixing roller 12A rotates counterclockwise in FIG. 8, and is looped over the rollers R11, R14, and R15. The backup member 13B, serving as a pressing pad, faces an inner circumferential surface of the pressing belt 13A to cause the pressing belt 13A to contact the fixing roller 12A and form a fixing nip portion N' between the fixing roller 12A and the pressing belt 13A. The heater 12H is provided inside the fixing roller 12A, and generates heat to heat the fixing roller 12A. The heater 13H' is provided inside the roller R14, and generates heat to heat the pressing belt 13A.

The oil applier 21 depicted in FIG. 4 applies oil to the fixing roller 12A provided above the pressing belt 13A. The oil applier 22 depicted in FIG. 4 applies oil to the pressing belt 13A provided under the fixing roller 12A.

Figure 9:
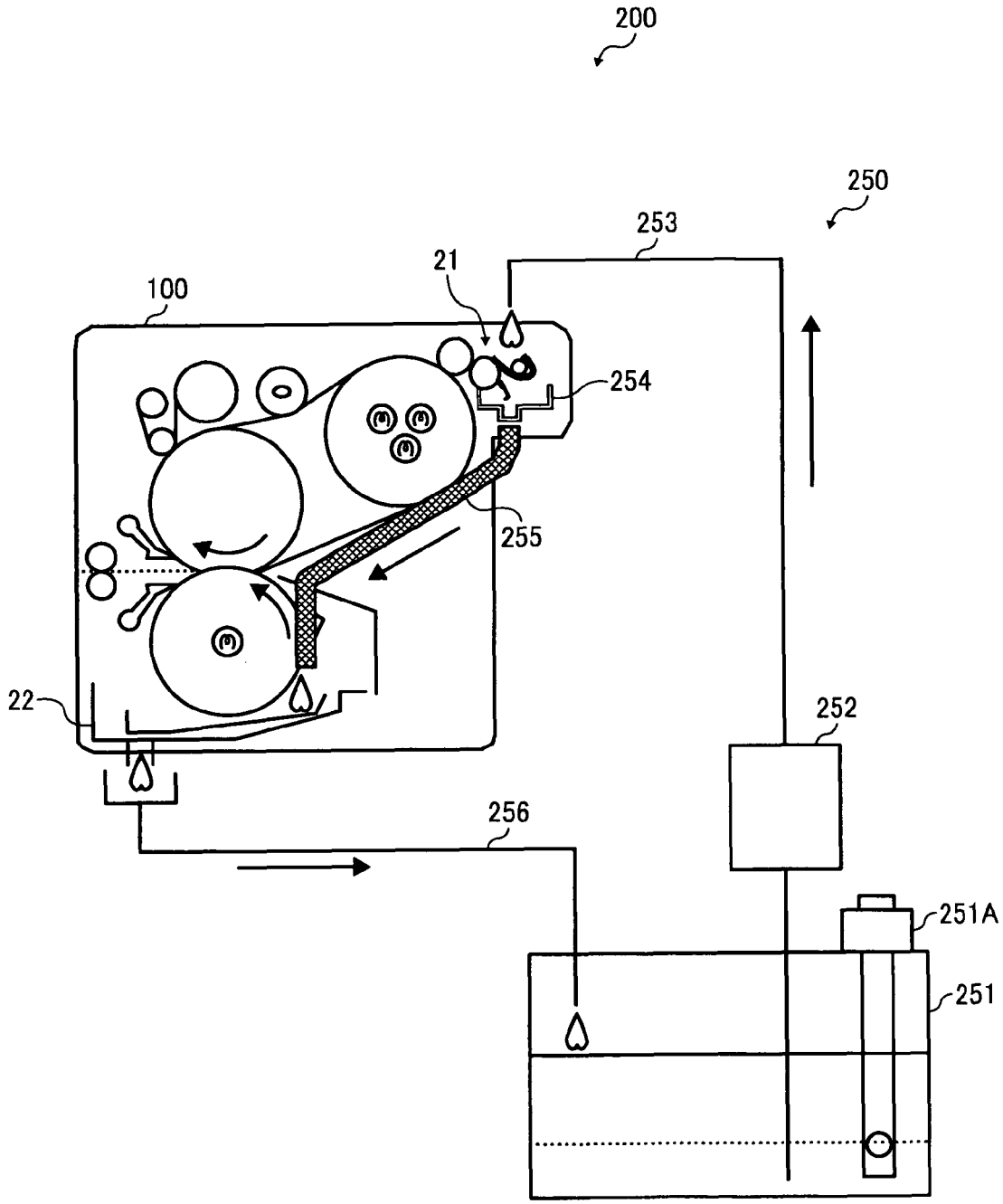
FIG. 9 is a schematic view of an oil circulation system (according to an example embodiment) included in the image forming apparatus shown in FIG. 3.

Referring to FIG. 9, the following describes the oil circulation mechanism 250, serving as an oil circulation system, included in the image forming apparatus 200. FIG. 9 is a schematic view of the oil circulation mechanism 250. The oil circulation mechanism 250 further includes a conveyance path 253, an oil receiver 254, a tube 255, and/or a conveyance path 256. The oil tank 251 includes an oil sensor 251A.

The oil tank 251 contains oil to be used in the fixing device 100. The oil pump 252 uses a piezoelectric element. The conveyance path 253 connects the oil pump 252 to the oil applier 21 of the fixing device 100. The oil receiver 254 receives surplus oil sent from the oil applier 21. The tube 255 conveys the oil sent from the oil receiver 254 to the oil applier 22. The conveyance path 256 connects the oil applier 22 to the oil tank 251. The oil tank 251, the oil pump 252, and the conveyance paths 253 and 256 are disposed outside the fixing device 100. The oil receiver 254 and the tube 255 are disposed inside the fixing device 100. The oil sensor 251A detects an amount of oil remaining in the oil tank 251.

In the image forming apparatus 200, the oil circulation mechanism 250 circulates oil as described below so that the oil appliers 21 and 22 sequentially apply oil to the fixing belt 12 and the pressing roller 13 depicted in FIG. 4, respectively.

For example, when an image forming operation starts, the oil pump 252 pumps silicon oil from the oil tank 251, which stores a total volume of about 4 liters of silicon oil, and conveys the oil to the oil applier 21 through the conveyance path 253. For example, the oil is put into the oil applier 21 at a supply speed of about 3 grams per minute.

The oil receiver 254 collects surplus oil from the oil applier 21. The surplus oil is conveyed to the sub oil pan 22A1 of the oil applier 22 provided for the pressing roller 13 (depicted in FIG. 5) through the tube 255.

Oil used in the oil applier 22 is collected into the oil tank 251 through the conveyance path 256.

Figure 10:
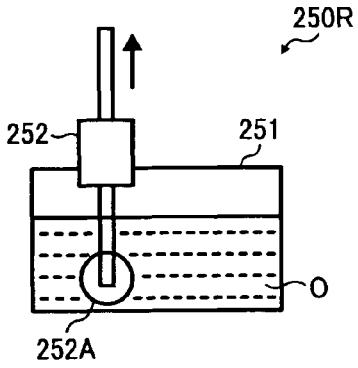
FIG. 10 is a sectional view of a reference oil circulation system.

In the oil circulation mechanism 250, solid impurities, such as dust and calcium carbonate originating from a sheet P, are mixed with oil. When oil mixed with solid impurities is circulated, the solid impurities are adhered to devices provided in an oil circulation path, resulting in malfunction of such devices and formation of a faulty image. To address this, a reference oil circulation mechanism (e.g., a reference oil circulation system) may include an oil filter to remove solid impurities, as illustrated in FIG. 10. FIG. 10 is a sectional view of a reference oil circulation mechanism 250R. The reference oil circulation mechanism 250R includes the oil tank 251, the oil pump 252, and/or an oil filter 252A.

The oil filter 252A is provided on an oil inlet of the oil pump 252. The oil filter 252A filters oil O contained in the oil tank 251 to remove solid impurities from the oil O, and the oil pump 252 pumps the filtered oil O. Accordingly, the solid impurities do not enter the oil circulation path.

However, when the oil pump 252 continuously pumps the filtered oil O, the solid impurities may adhere to and clog the oil filter 252A. Accordingly, the oil pump 252 may pump a decreased amount of oil O, resulting in degraded image quality due to shortage of oil O. The oil filter 252A provided on the small oil inlet of the oil pump 252 may be clogged with solid impurities easily.

Figure 11:
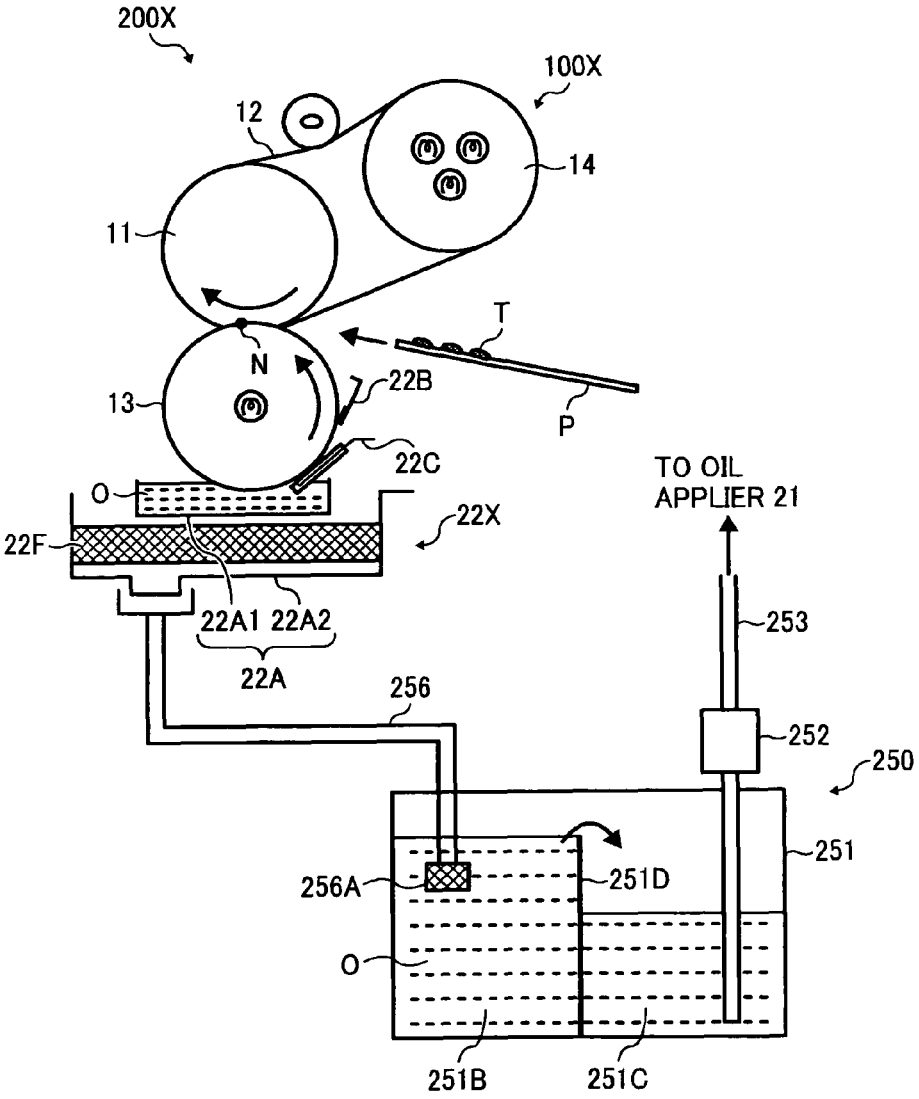
FIG. 11 is a schematic view of an image forming apparatus according to yet another example embodiment.

Referring to FIG. 11, the following describes an image forming apparatus 200X according to another example embodiment. FIG. 11 is a schematic view of the image forming apparatus 200X. The image forming apparatus 200X includes a fixing device 100X and/or the oil circulation mechanism 250. The fixing device 100X includes the fixing roller 11, the fixing belt 12, the pressing roller 13, the heating roller 14, and/or an oil applier 22X. The oil applier 22X includes the oil pan 22A, the blade 22B, the cleaning felt 22C, and/or an oil filter 22F. The oil pan 22A includes the sub oil pan 22A1 and/or the main oil pan 22A2. The oil circulation mechanism 250 further includes an oil filter 256A, a sedimentation tank 251B, a supply tank 251C, and/or a divider 251D.

In the fixing device 100X, the rotatable fixing belt 12, serving as a first nip formation member and a fixing member, contacts the rotatable pressing roller 13, serving as a second nip formation member and a pressing member, provided under the fixing belt 12 to form the fixing nip portion N between the fixing belt 12 and the pressing roller 13. The sub oil pan 22A1, serving as an oil pan, is provided under the pressing roller 13 and contains oil O in which a part of the pressing roller 13 is dipped. The main oil pan 22A2, serving as an oil receiver, holds the sub oil pan 22A1. The oil filter 22F is provided between the sub oil pan 22A1 and the main oil pan 22A2. For example, the oil filter 22F is provided inside the main oil pan 22A2 and under the sub oil pan 22A1, and filters oil O overflowing the sub oil pan 22A1.

The oil circulation mechanism 250 resupplies oil O filtered by the oil filter 22F and sent from the oil applier 22X to the oil appliers 21 and 22X. FIG. 11 illustrates the fixing device 100X and the oil circulation mechanism 250 partially. However, the fixing device 100X is equivalent to the fixing device 100 depicted in FIGS. 4 and 5 except the oil filter 22F, and the oil circulation mechanism 250 is identical to the oil circulation mechanism 250 depicted in FIG. 9.

The oil filter 22F is formed of a sheet having a width equal to or longer than the width of the pressing roller 13 in the axial direction of the pressing roller 13. The oil filter 22F may be a compressed sheet including heat-resistant fiber not reacting to oil, such as meta-aramid fiber. While oil O permeates the fiber of the oil filter 22F, the oil filter 22F captures fine solid impurities inside. Thus, the oil filter 22F provided in the oil pan 22A can remove fine solid impurities (e.g., dust and calcium carbonate originating from a sheet P) from oil O permeating the oil filter 22F. The oil filter 22F may include a material equivalent to felt used in other members, such as the oil spatter prevention member 22D (depicted in FIG. 7) having a sheet shape. However, the oil filter 22F may include a mesh finer than a mesh of such members in a reference range so that the oil filter 22F can filter oil O.

The oil applier 22X may include the oil spatter prevention member 22D.

Referring to FIGS. 9 and 11, the following describes circulation processes for circulating oil O with the above-described structure.

As illustrated in FIG. 11, the oil filter 22F filters oil O used in the oil applier 22X, that is, oil O overflowing the sub oil pan 22A1 into the main oil pan 22A2, to remove solid impurities from the oil O. The filtered oil O is sent from the outlet of the main oil pan 22A2 into the oil tank 251 through the conveyance path 256. The oil pump 252 pumps oil O stored in the oil tank 251 to supply the oil O to the oil applier 21 through the conveyance path 253. The oil applier 21 applies the oil O to the fixing belt 12.

As illustrated in FIG. 9, the oil receiver 254 collects surplus oil O contained in the oil applier 21. The oil O is supplied to the sub oil pan 22A1 of the oil applier 22X provided for the pressing roller 13 (depicted in FIG. 11) through the tube 255. The oil applier 22X applies the oil O to the pressing roller 13. The oil filter 22F filters the oil O used in the oil applier 22X again. Thereafter, the above-described circulation processes are repeated to reuse the oil O.

According to this example embodiment, no oil filter is provided on the oil inlet of the oil pump 252 directly. Accordingly, even when the oil pump 252 is used for a long time period, an amount of oil O pumped by the oil pump 252 may not decrease. The oil filter 22F, which is formed of a large sheet having the width equal to or longer than the width of the pressing roller 13 in the axial direction of the pressing roller 13, filters oil O overflowing the sub oil pan 22A1. Accordingly, even when the oil pump 252 is used for a long time period, the oil pump 252 may not be clogged with solid impurities. Thus, impurities may not enter the oil circulation path, and a sufficient amount of oil O can be supplied to the oil appliers 21 and 22X. Consequently, the oil appliers 21 and 22X can apply a sufficient amount of oil O not containing impurities to the fixing belt 12 and the pressing roller 13, respectively, so as to provide improved property for separating a sheet P from the fixing belt 12 and the pressing roller 13 and maintain improved image quality.

When the oil filter 22F is provided, the oil filter 256A may be provided secondarily at an end of the conveyance path 256 provided in the oil tank 251 to filter oil O to remove impurities from the oil O. Thus, the oil O circulating in the fixing device 100X and the oil circulation mechanism 250 can contain further reduced impurities.

In the oil tank 251, the divider 251D may be provided to divide the oil tank 251 into two tanks, which are the sedimentation tank 251B and the supply tank 251C. Oil O sent from the conveyance path 256 enters the sedimentation tank 251B. After solid impurities are sedimented in the sedimentation tank 251B, supernatant oil O overflowing the sedimentation tank 251B and crossing over the divider 251D is stored in the supply tank 251C. The oil pump 252 pumps oil O from the supply tank 251C. Thus, impurities are further removed from oil O in the sedimentation tank 251B.

As illustrated in FIG. 11, in a fixing device (e.g., the fixing device 100X) according to the above-described example embodiments, an oil filter (e.g., the oil filter 22F) is provided in an oil receiver (e.g., the main oil pan 22A2) holding an oil pan (e.g., the sub oil pan 22A1). Therefore, the oil filter can have a large size. Even when the oil filter filters oil to remove solid impurities from the oil for a long time period, the oil filter may not be clogged with the solid impurities. Further, the oil discharged from the fixing device can be reused. Moreover, the oil filter is provided in the existing oil pan, saving space.

In an image forming apparatus (e.g., the image forming apparatus 200X) according to the above-described example embodiments, oil from which the fixing device removes impurities is sent to an oil circulation system (e.g., the oil circulation mechanism 250). Accordingly, the oil circulation system may not pump a decreased amount of oil to be circulated. Consequently, a sufficient amount of oil can be applied to members for forming a fixing nip portion (e.g., the fixing nip portion N), which are a first nip formation member (e.g., the fixing belt 12) and a second nip formation member (e.g., the pressing roller 13), so as to provide improved property for separating a sheet from the first nip formation member and the second nip formation member.

According to the above-described example embodiments, the image forming apparatus including the fixing device can provide improved fixing and separation functions, and therefore can handle various types of paper, such as thin paper and thick paper, and various types of image formation, such as a narrower top margin on a sheet.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a rotatable first nip formation member;

a rotatable second nip formation member provided under the first nip formation member to directly contact the first nip formation member; and an oil applier, the oil applier including:

an oil pan provided under the second nip formation member to contain oil in which the second nip formation member is partially submerged in oil;

an oil receiver to hold the oil pan; and an oil filter provided between the oil pan and the oil receiver to filter oil overflowing the oil pan, the oil filter being formed of a sheet having a width equal to or longer than a width of the second nip formation member in a diametrical direction of the second nip formation member, wherein the oil filter covers a region of an oil surface contained in the oil pan and the oil receiver other than a region of the oil surface of oil in which the second nip formation member is partially submerged.

2. An image forming apparatus, comprising:

an oil circulation system to circulate oil; and a fixing device to receive oil sent from the oil circulation system, the fixing device including:

a rotatable first nip formation member;

a rotatable second nip formation member provided under the first nip formation member to directly contact the first nip formation member; and an oil applier, including:

an oil pan provided under the second nip formation member to contain oil in which the second nip formation member is partially submerged in oil;

an oil receiver to hold the oil pan; and an oil filter provided between the oil pan and the oil receiver to filter oil overflowing the oil pan, the oil filter being formed of a sheet having a width equal to or longer than a width of the second nip formation member in a diametrical direction of the second nip formation member, wherein the oil filter covers a region of an oil surface contained in the oil pan and the oil receiver other than a region of the oil surface of oil in which the second nip formation member is partially submerged, and the oil circulation system receiving oil filtered by the oil filter and resupplying the filtered oil to the oil applier of the fixing device.

3. The fixing device according to claim 1, wherein a fixing nip portion in which a sheet passes therethrough is formed between the first nip formation member and the second nip formation member.

4. The fixing device according to claim 1, wherein a long length of the oil pan is equal to or longer than at least a long length of the second nip formation member.

5. The fixing device according to claim 1, wherein the second nip formation member is constantly submerged in the oil contained in the oil pan.

6. The fixing device according to claim 5, wherein an oil level of the oil contained in the oil pan is higher than a lower end of the second nip formation member.

7. The fixing device according to claim 6, wherein the lower end of the second nip formation member does not contact an inner bottom of the oil pan even when pressure is applied to the second nip formation member.

8. The fixing device according to claim 1, wherein the oil receiver includes an outlet at a bottom thereof so as to divert the oil to an oil tank.

9. The fixing device according to claim 1, wherein a surface of the second nip formation member includes a material corresponding to a material of the oil.

10. The fixing device according to claim 9, wherein the surface of the second nip formation member is made of silicon rubber.

11. The fixing device according to claim 1, further comprising a blade, wherein the blade contacts a lower surface of the second nip formation member to regulate the oil uniformly in a width direction thereof and scrape off excess oil on the surface of the second nip formation member.

12. The fixing device according to claim 11, wherein the scraped oil is collected into the oil pan and reused.

13. The fixing device according to claim 11, further comprising a cleaning felt provided between the oil pan and the blade, to clean the surface of the second nip formation member of fine solid impurities.

14. The fixing device according to claim 1, wherein the sheet of the oil filter is a compressed sheet including heat-resistant fibers not reacting to oil.

15. A fixing device, comprising:

a rotatable first nip formation member;

a rotatable second nip formation member provided under the first nip formation member to contact the first nip formation member;

a first oil applier to apply oil to the first nip formation member; and a second oil applier to apply oil to the second formation member, the second oil applier including:

an oil pan provided under the second nip formation member to contain oil in which the second nip formation member is partially submerged in oil;

an oil filter provided between the oil pan and the oil receiver to filter oil overflowing the oil pan, the oil filter being formed of a sheet having a width equal to or longer than a width of the second nip formation member in a diametrical direction of the second nip formation member; and an oil receiver to hold the oil pan, wherein the oil filter covers a region of an oil surface contained in the oil pan and the oil receiver other than a region of the oil surface of oil in which the second nip formation member is partially submerged.

16. The fixing device according to claim 15, wherein oil collected by the first oil applier is supplied to the oil pan of the second oil applier.

17. The fixing device according to claim 16, wherein the first oil applier and the second oil applier are connected by a tube so as to supply oil from the first oil applier to the second oil applier.

* * * * *